US011551863B2

(12) United States Patent
Shimizu et al.

(10) Patent No.: US 11,551,863 B2
(45) Date of Patent: Jan. 10, 2023

(54) DRAM-TYPE MAGNETIC BODY HAVING PAIR OF FLANGE PARTS ON BOTH ENDS OF SHAFT PART

(71) Applicant: TAIYO YUDEN CO., LTD., Tokyo (JP)

(72) Inventors: Makoto Shimizu, Takasaki (JP); Yusuke Nagai, Takasaki (JP)

(73) Assignee: TAIYO YUDEN CO., LTD, Tokyo (JP)

( * ) Notice: Subject to any disclaimer, the term of this patent is extended or adjusted under 35 U.S.C. 154(b) by 657 days.

(21) Appl. No.: 16/593,794

(22) Filed: Oct. 4, 2019

(65) Prior Publication Data

US 2020/0035411 A1 Jan. 30, 2020

Related U.S. Application Data

(62) Division of application No. 15/276,680, filed on Sep. 26, 2016, now Pat. No. 10,475,572.

(30) Foreign Application Priority Data

Sep. 30, 2015 (JP) ..... 2015-193405

(51) Int. Cl.
*H01F 41/02* (2006.01)
*H01F 3/08* (2006.01)
(Continued)

(52) U.S. Cl.
CPC ..... *H01F 41/0246* (2013.01); *H01F 3/08* (2013.01); *H01F 27/24* (2013.01); *H01F 27/255* (2013.01);
(Continued)

(58) Field of Classification Search
CPC ..... H01F 41/0246; H01F 3/08; H01F 27/24; H01F 27/255; H01F 27/2823; H01F 27/29; H01F 41/0206; Y10T 29/49075
See application file for complete search history.

(56) References Cited

U.S. PATENT DOCUMENTS 5,966,065 A 10/1999 Onizuka et al.
2003/0116671 A1 6/2003 Okamoto
(Continued)

FOREIGN PATENT DOCUMENTS

CN 101689421 A 3/2010
CN 104124021 A 10/2014
(Continued)

OTHER PUBLICATIONS

A First Office Action issued by the State Intellectual Property Office of China dated Feb. 28, 2018 for Chinese counterpart application No. 201610875760.6.
(Continued)

*Primary Examiner* — Carlos Amaya
(74) *Attorney, Agent, or Firm* — Law Office of Katsuhiro Arai

(57) ABSTRACT

A drum-type magnetic body includes: a pair of flange parts that are facing each other; and a shaft part connecting the pair of flange parts, wherein an outer periphery of a cross section of the shaft part in a direction orthogonal to an axis of the shaft part has an oval shape constituted by a pair of parallel straight parts and a pair of arc parts connecting end parts of the pair of parallel straight parts, and the flange parts each have an outer principal face running orthogonal to the axis of the shaft part, and the pair of parallel straight parts are running in parallel with a longitudinal direction of the principal face of the flange part.

9 Claims, 13 Drawing Sheets

(51) Int. Cl.

| | |
|---|---|
| ***H01F 27/24*** | (2006.01) |
| ***H01F 27/255*** | (2006.01) |
| ***H01F 27/28*** | (2006.01) |
| ***H01F 27/29*** | (2006.01) |

(52) U.S. Cl.
CPC ..... *H01F 27/2823* (2013.01); *H01F 27/29* (2013.01); *H01F 41/0206* (2013.01); *Y10T 29/49075* (2015.01)

(56) References Cited

U.S. PATENT DOCUMENTS

| | | | |
|---|---|---|---|
| 2011/0115599 | A1 | 5/2011 | Otsuki et al. |
| 2017/0025215 | A1 | 1/2017 | Nishimura et al. |

FOREIGN PATENT DOCUMENTS

| | | | | | |
|---|---|---|---|---|---|
| JP | H10294232 | A | | 11/1998 | |
| JP | 2000208328 | A | | 7/2000 | |
| JP | 2003031431 | A | | 1/2003 | |
| JP | 2005132700 | A | | 5/2005 | |
| JP | 4217142 | B2 | | 1/2009 | |
| JP | 2014058007 | A | | 4/2014 | |
| JP | 2016039373 | | * | 3/2016 | ..... H01F 17/04 |
| JP | 5954071 | B2 | | 7/2016 | |
| WO | 2015137452 | A1 | | 9/2015 | |

OTHER PUBLICATIONS

Final Office Action issued by U.S. Patent and Trademark Office, dated Apr. 12, 2019, for related U.S. Appl. No. 15/276,680 (10 pages).

Non-Final Office Action issued by U.S. Patent and Trademark Office, dated Sep. 10, 2018, for related U.S. Appl. No. 15/276,680 (14 pages).

Notice of Allowance issued by U.S. Patent and Trademark Office, dated Jul. 8, 2019, for related U.S. Appl. No. 15/276,680 (16 pages).

* cited by examiner 210
212
214
208
208
216
FB
FA 208
216
208
214

210
212
208
208
214
216

212
208
214
208
210
218
216
96

DRAM-TYPE MAGNETIC BODY HAVING PAIR OF FLANGE PARTS ON BOTH ENDS OF SHAFT PART

CROSS-REFERENCE TO RELATED APPLICATIONS

This application is a divisional of U.S. patent application Ser. No. 15/276,680, filed Sep. 26, 2016, which claims priority to Japanese Patent Application No. 2015-193405, filed Sep. 30, 2015, the disclosure of which is incorporated herein by reference in its entirety including any and all particular combinations of the features disclosed therein. The applicant herein explicitly rescinds and retracts any prior disclaimers or disavowals made in any parent, child or related prosecution history with regard to any subject matter supported by the present application.

BACKGROUND

Field of the Invention

The present invention relates to a method of manufacturing a so-called drum-type core, comprising a conductive wire wound around a shaft part having flange parts on both ends, which is a magnetic body used for a wire-wound electronic component having a wound conductive wire, and more specifically to a drum core designed to increase the core density, prevent wire breakage or winding disorder, and improve the winding efficiency.

Description of the Related Art

With the popularity of mobile devices offering multiple functions and computerization of cars, so-called chip-type components that are small in size but still having a wound wire, are becoming increasingly common. Particularly in the area of coil components for power systems, a drum core having flange parts on both ends of a shaft part around which a wire is wound is used to support lower resistance, and there is a need for drum cores offering high performance and dimensional accuracy to support increasingly thinner components.

Methods of manufacturing the drum cores mentioned above include, for example, the method of manufacturing an inductance core disclosed in Patent Literature 1 below. This art is a method of manufacturing a core, which is called drum core, used for achieving inductance characteristics, where the method is based on a traditional grinding process. According to the traditional grinding process, however, the core part is formed by turning the work (compact) with reference to the outer periphery surfaces corresponding to the flange parts, so the outer periphery shape of the core part is roughly the same as the outer periphery shape of the flange part. For this reason, the aforementioned manufacturing method described in Patent Literature 1 is such that a rotational reference part is provided on the outer side of the part corresponding to each flange part and this rotational reference part is given an oval shape to give an oval shape to the core part. This method requires forming, grinding, and polishing in order to obtain the drum core shape.

Additionally, Patent Literature 2 below discloses a method for press-forming a chip coil core. Use of press forming requires some ingenuity regarding dies, and under this art, an arc surface and press-receiving surface are provided on the dies used to form the winding core part in order to reduce damage to the dies. By winding a wire around a core thus formed, the wire can achieve closer contact with the winding core part compared with when a conventional winding core part of square or polygonal shape is used.

BACKGROUND ART LITERATURES

[Patent Literature 1] Japanese Patent Laid-open No. 2014-058007

[Patent Literature 2] Japanese Patent Laid-open No. Hei 10-294232

SUMMARY

However, the art described in Patent Literature 1 above combines grinding and polishing to form (drum) cores of various shapes, which increases the design flexibility of the shaft in that it can be shaped in a manner making the winding easy. On the other hand, however, this method requires many man-hours and uses many parts that must be processed, and consequently the resulting core shape can have lower dimensional accuracy compared to when it is formed by molding. In addition, designing thinner components means the thickness of core flanges must be reduced; with this art, however, the flanges are also formed by grinding and polishing and thus vulnerable to chipping, and if the flanges are made thin, they break off easily, posing problems. Furthermore, the polishing step requires extra material and adds to man-hours and consequently increases the cost, which is another problem.

On the other hand, the art described in Patent Literature 2 above uses molding almost entirely to form a magnetic body, which makes it easier to ensure dimensional accuracy compared to when grinding is used. However, the dies have complex shapes and are therefore easy to break, and also especially because the molding pressure is restricted, obtaining a highly-filled compact is difficult. Moreover, having to combine the dies makes the lines corresponding to die joints prone to burrs, and in particular, the thinner the shape, the more difficult it becomes to remove these burrs that can cause wire breakage, flaws, and/or winding disorder of the conductive wire of the coil component.

As mentioned above, no drum was available which could be used as a wire-wound coil component having an easy-to-wind shaft shape and supporting a magnetic body of higher fill ratio; accordingly a magnetic body is desired which can be used for a wire-wound coil component that can support a so-called chip-type small component.

The present invention was developed with focus on the aforementioned points, and its object is to provide a method of manufacturing a magnetic body used for a wire-wound coil component that ensures ease of winding, dimensional accuracy, and higher fill ratio of the magnetic body, prevents wire breakage and winding disorder of the winding wire, and improves the winding efficiency, as well as a method of manufacturing such coil component.

The method of manufacturing a magnetic body proposed by the present invention is characterized by comprising: a molding step to pressure-mold a magnetic material into a compact corresponding to H-beam steel (a wide flange shape having an H-shaped cross section), constituted by a pair of flange parts that are facing each other and a web part connecting the pair of flange parts; a grinding step to turn the compact around a rotational shaft being the shaft extending from one of the pair of flange parts to the other flange part by passing through the web part, and grind the web part to form a drum-type ground product having a pair of flange parts on both ends of the shaft part; and a heat-treatment step to heat-treat the ground product to obtain a drum-type magnetic body.

One key embodiment is characterized in that, in the grinding step, the outer periphery of a section of the shaft part in the direction orthogonal to the rotational shaft is formed by a pair of straight parts that are facing each other and also by a pair of arc parts connecting the end parts of the pair of straight parts, while the flange parts each have an outer principal face running orthogonal to the rotational shaft, and the pair of straight parts are running in parallel with the longitudinal direction of the principal face of the flange part in the plane orthogonal to the rotational shaft. Another embodiment is characterized in that, in the grinding step, the web part is ground to a width narrower than the spacing between the outer margin parts of the facing surfaces of the pair of flange parts.

Yet another embodiment is characterized in that tapered surfaces are provided where the facing surfaces of the pair of flange parts of the compact intersect the web part and, in the grinding step, both margins of the ground width are positioned above the tapered surfaces. Yet another embodiment is characterized in that tapered surfaces are provided on the facing surfaces of the pair of flange parts of the compact in such a way that the thickness of the flange part decreases from the web part side toward the outer margin part of the flange part, and, in the grinding step, both margins of the ground width are positioned above the tapered surfaces. Yet another embodiment is characterized in that tapered surfaces are provided where the outer margin parts of the pair of flange parts of the compact intersect the end faces of the web part, in such a way that the web part side is concaved, and, in the grinding step, both margins of the ground width are positioned above the tapered surfaces.

The method of manufacturing a coil component proposed by the present invention is characterized in that a conductive wire with sheath is wound around a magnetic body formed according to the aforementioned manufacturing method. The aforementioned and other objects, characteristics, and benefits of the present invention are made clear in the detailed explanations below as well as the drawings attached hereto.

Any discussion of problems and solutions involved in the related art has been included in this disclosure solely for the purposes of providing a context for the present invention, and should not be taken as an admission that any or all of the discussion were known at the time the invention was made.

According to the present invention, high pressure can be applied to the compact corresponding to H-beam steel, and also by grinding the web part, a shaft shape can be obtained while leaving a portion of the web part. As a result, the magnetic body can be made into a drum core of high filling ratio that supports easy winding.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 2A is a plan view, FIG. 2B is a side view of FIG. 2A from the direction of arrow FA, and FIG. 2C is a side view of FIG. 2A from the direction of arrow FB.

FIG. 4A is a plan view, FIG. 4B is a side view of FIG. 4A from the direction of arrow FA, FIG. 4C is a side view of FIG. 4A from the direction of arrow FB, and FIG. 4D is a perspective view of the exterior.

FIG. 5A is a side view and FIG. 5B is a perspective view of the exterior.

FIG. 6A is a plan view, FIG. 6B is a side view of FIG. 6A from the direction of arrow FA, and FIG. 6C is a side view of FIG. 6A from the direction of arrow FB.

FIG. 7A is a plan view, FIG. 7B is a side view of FIG. 7A from the direction of arrow FA, FIG. 7C is a side view of FIG. 7A from the direction of arrow FB, and FIG. 7D is a perspective view of the exterior.

FIG. 8A is a plan view, FIG. 8B is a side view of FIG. 8A from the direction of arrow FA, and FIG. 8C is a side view of FIG. 8A from the direction of arrow FB.

FIG. 9A is a plan view, FIG. 9B is a side view of FIG. 9A from the direction of arrow FA, FIG. 9C is a side view of FIG. 9A from the direction of arrow FB, and FIG. 9D is a perspective view of the exterior.

FIG. 10A is a plan view, FIG. 10B is a side view of FIG. 10A from the direction of arrow FA, and FIG. 10C is a side view of 10A from the direction of arrow FB.

FIG. 11A is a plan view, FIG. 11B is a side view of FIG. 11A from the direction of arrow FA, FIG. 11C is a side view of FIG. 11A from the direction of arrow FB, and FIG. 11D is a perspective view of the exterior.

DESCRIPTION OF THE SYMBOLS

10: Die

10A: Convex die

Figure 1A:
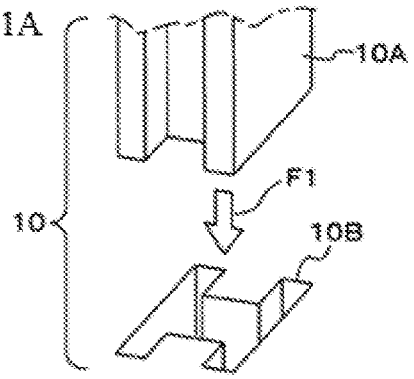
FIGS. 1A to 1E are drawings showing how the drum core in Example 1 of the present invention is manufactured.

10B: Concave die
16: Compact
16A, 16B: Pressurization surface
18, 20: Flange part
18A, 20A: Principal face
18B, 20B: Outer margin part
18C, 20C: Inner face
22: Groove
24: Web part
28: Grinding blade
30: Ground product
32, 34: Flange part
36, 36': Shaft part
36A, 36B: Formed surface
36C, 36D: Ground surface
38A, 38B: Straight part
38C, 38D: Arc part
40, 40': Drum core (magnetic body)
42: Conductive wire with sheath
44A, 44B: Terminal electrode
46: Exterior part
50: Coil component
60A, 60B: Ground product
62, 66: Step part
70: Compact
72, 74: Flange part
72A, 72B, 74A 74B: Inner face
76: Web part
76A, 76B: Side face
78: Tapered surface
80: Grinding blade
90: Ground product
92, 94: Flange part
96: Shaft part
98: Step part
150: Compact
152, 154: Flange part
152A, 152B, 154A, 154B: Inner face (tapered surface)
156: Web part
156A, 156B: Side face
160: Ground product
162, 164: Flange part
166: Shaft part
168: Step part
170: Chamber
200: Compact
202, 204: Flange part
202A, 202B, 204A, 204B: Inner face
203, 205: Outer margin part
206: Web part
206A, 206B: End face
206C, 206D: Side face
208: Tapered surface
210: Ground product
212, 214: Flange part
216: Shaft part
218: Step part
250: Compact
252, 254: Flange part
256: Web part
260: Ground product
262, 264: Flange part
266: Shaft part
X: Rotational shaft

DETAILED DESCRIPTION OF EMBODIMENTS

The best modes for carrying out the present invention are explained in detail below based on examples.

Example 1

Figure 1B:
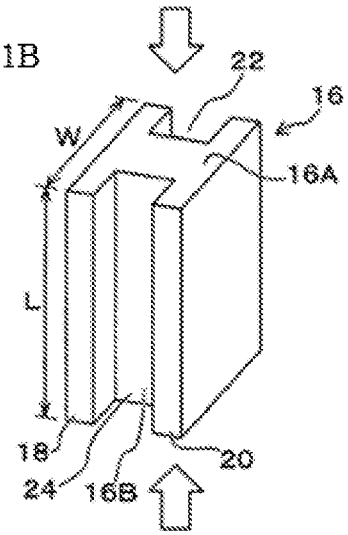
Figure 1C:
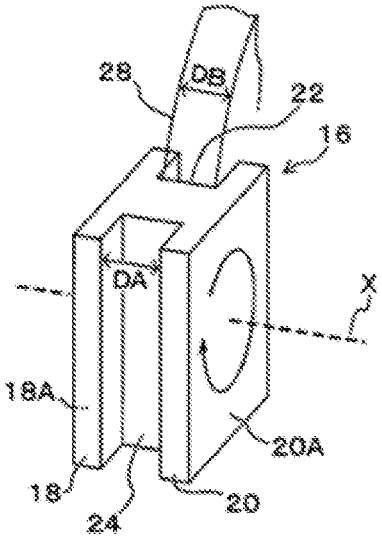
Figure 1D:
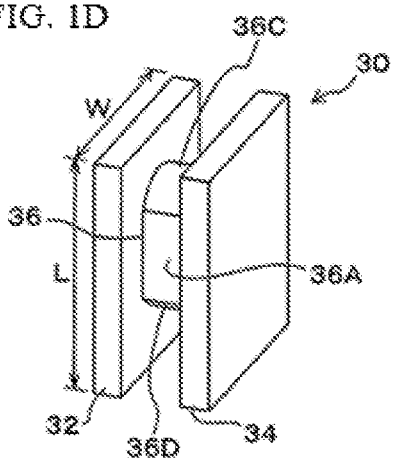
Figure 2A:
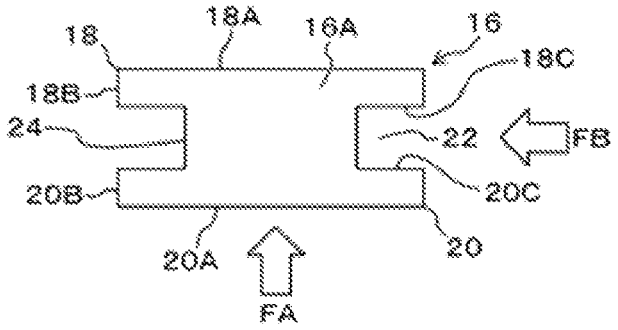
FIGS. 2A to 2C are drawings showing the compact in Example 1, where
Figure 2B:
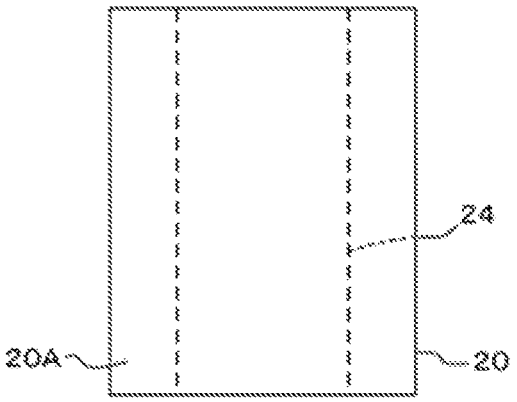
Figure 2C:
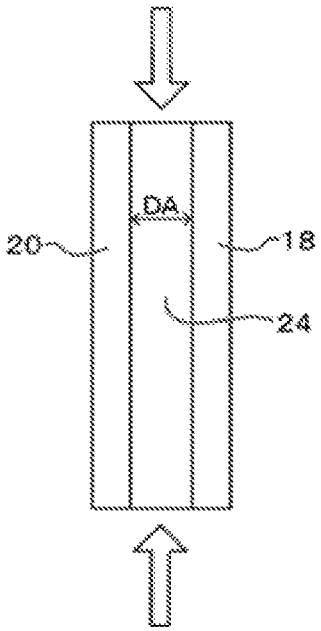
Figure 3A:
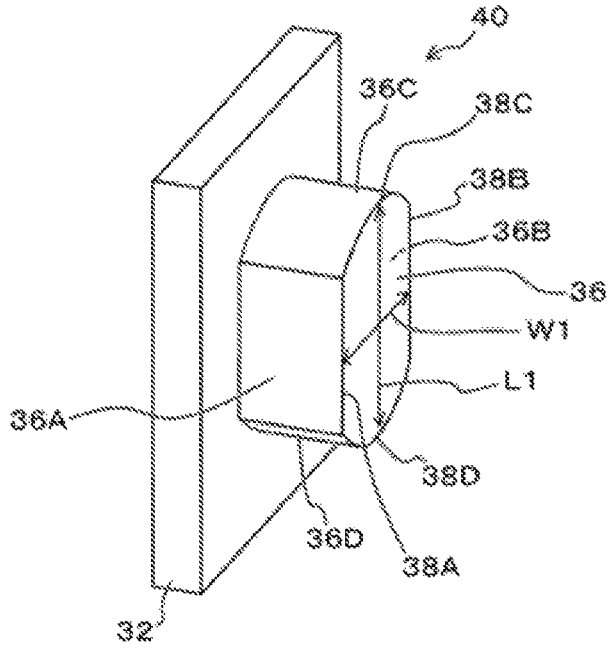
FIG. 3A is a perspective view showing the shape of the shaft part of the drum core in Example 1.
Figure 3B:
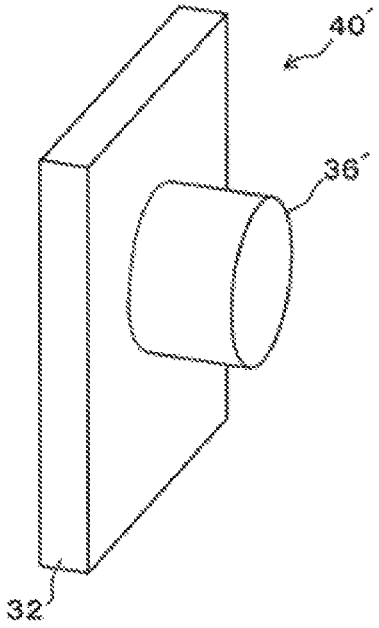
FIG. 3B is showing the same of a drum core formed according to a traditional manufacturing method.

First, Example 1 of the present invention is explained by referring to FIGS. 1A to 3B. This example shows the basic structure of the drum core proposed by the present invention, and the manufacturing method thereof. FIGS. 1A to 1E are drawings showing how the drum core in this example is manufactured. FIGS. 2A to 2C are drawings showing a compact before it is ground to the shape of the drum core, where FIG. 2A is a plan view, FIG. 2B is a side view of FIG. 2A from the direction of arrow FA, and FIG. 2C is a side view of FIG. 2A from the direction of arrow FB. FIG. 3A is a perspective view showing the shaft shape of the drum core in this example and FIG. 3B shows the same of a drum core formed according to a traditional manufacturing method. According to the present invention, a compact corresponding to H-beam steel, constituted by a pair of flange parts that are facing each other and a web part connecting the pair of flange parts, is formed by pressure-molding of magnetic material. It should be noted that the expression "corresponding to H-beam steel" does not necessary mean "made of steel material"; instead, this phrase is used to easily portray the shape of the compact by association with the H-beam steel commonly used as construction material, etc. In other words, a compact corresponding to H-beam steel is such that, when viewed from the direction of the H shape, it has a thickness-direction dimension extending from one flange part to the other flange part, as well as a width-direction dimension in the direction vertical to the thickness direction, and when viewed from either side face having a groove of the H shape, it has a length-direction dimension in the direction vertical to the thickness direction. Thereafter, the web part is ground by turning the compact, to form a drum-type ground product having a pair of flange parts on both ends of the shaft part, after which the obtained ground product is heat-treated to obtain a drum-type magnetic body, or specifically a drum core.

Figure 1E:
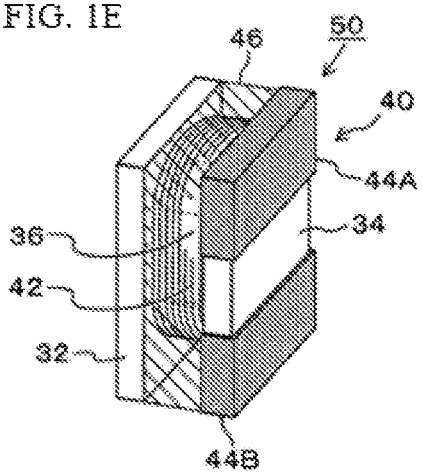

As shown in FIG. 1E, a drum core 40 in this example is constituted in such a way that a pair of flange parts 32, 34 that are facing each other, are provided on both ends of a shaft part 36 around which a winding wire with sheath 42 is wound. In the example illustrated, the flange parts 32, 34 are each a rectangle of 1.6 mm in width W and 2.0 mm in length L. Also, in this example, the section of the shaft part 36 orthogonal to the shaft is an oval constituted by a pair of straight parts 38A, 38B and a pair of arc parts 38C, 38D connecting the end parts of the straight parts 38A, 38B, as shown in FIG. 3A. Oval is a shape consisting of two parallel straight lines connected to each other by arcs at both ends, where the outer periphery of the shaft section is formed by a continuous oval-shaped line. In the example illustrated, the short side W1 of the shaft part 36 is 0.8 mm long, while the long side L1 is 1.0 mm long, and the ratio of the width W and length L of the flange parts 32, 34 is substantially or approximately the same as the ratio of the short side W1 and long side L1 of the shaft part 36. By designing the section dimensions of the shaft part 36 this way according to the outer shape of the flange parts 32, 34, the axial cross-section area can be increased by approx. 30% regardless of the outer shape of the flange parts compared to a traditional drum core 40' whose shaft part 36' has a circular section shape as shown in FIG. 3B, and because change in the tension of the conductive wire can be suppressed as it is wound as a result, stable winding becomes possible.

The shaft part 36 of the aforementioned shape can be dimensionally adjusted according to the outer dimensions of the flange parts 32, 34 because the arc parts 38C, 38D are formed by grinding. How to specifically manufacture the drum core 40 is explained below. First, in the preparation step, magnetic grains are mixed with binder to obtain a molding material. Next, as shown in FIG. 1A, H-shaped dies 10 consisting of a convex die 10A and a concave die 10B are used to pressure-mold the magnetic material, into an H-shaped compact 16 as shown in FIG. 1B. The compact 16 has a pair of flange parts 18, 20 of roughly rectangular shape, and a web part 24 connecting these flange parts 18, 20. As shown in FIG. 2A, the flange parts 18, 20 have: principal faces 18A, 20A on the outer sides of the respective flange parts 18, 20; outer margin parts 18B, 20B of the respective flange parts 18, 20 contacting the respective principal faces 18A, 20A; and inner faces 18C, 20C of the respective flange parts 18, 20 contacting the respective outer margin parts 18B, 20B and the web part 24.

FIG. 2A shows a plan view of the compact 16 from the pressurization direction F1 shown in FIG. 1A, where pressurization surfaces 16A, 16B are H-shaped surfaces. Also, FIG. 2B shows a side view of FIG. 2A from the direction of arrow FA, where the entire principal faces on the outer sides of the flange parts 18, 20 are flat surfaces. The principal faces of the flange parts 18, 20 as shown in FIG. 2B each have an outer shape corresponding to a rectangle having a pair of long sides that are facing each other and a pair of short sides that are facing each other. The principal faces of the flange parts 18, 20 can have an outer shape being chamfered, for example, in which case the longitudinal direction of the principal faces of the flange parts 18, 20 represents the pressurization direction. Furthermore, FIG. 2C shows a side view of FIG. 2A from the direction of arrow FB, where the surface has a groove 24 at the center. Preferably the pressurization surfaces 16A, 16B are flat over the entire surface, so any concavity or projection is to be kept within 15% of the overall length of the compact 16. For example, when the flange parts 18, 20 have a length L of 2.0 mm, as mentioned above, any concavity or projection will not affect the stress concentration on the dies or uniformity of the compact if its length-direction dimension is kept within 0.2 mm at the longest, such as within 0.15 mm on both the pressurization surfaces 16A, 16B or within 0.1 mm on one surface and within 0.2 mm on the other surface. Up to 1.7 mm is permitted for the length of the web part 24.

Next, heat is applied to the compact 16 to form a cured product. Here, the heat treatment is given at 150° C., for example, to cure the binder mixed into the magnetic grains. Next, the hardened product is ground to form a ground product 30. As shown in FIG. 1C, grinding is performed by turning the hardened product around a rotational shaft X being the shaft passing through the centers of the principal faces 18A, 20A of the flange parts 18, 20, and applying a grinding blade 28 from the direction parallel with the turning direction. For the grinding blade 28, a blade whose width DB is slightly narrower than the spacing DA between the outer margin parts of the flange parts 18, 20 is used by setting the blade at a position where it does not project out of the groove 22. It should be noted that, in actual grinding, some areas may not be ground due to dimensional accuracy error and remain as step parts. Accordingly, these step parts are explained, along with a more ideal grinding method, in the examples that follow. It should be noted that the grinding blade 28 and dies 10 can have their corners rounded to R0.05 mm or so, as this prevents minor chipping and break-offs.

A ground product 30 as shown in FIG. 1D is obtained through the grinding step. The ground product 30 has a shaft part 36 formed by grinding the web part 24, and a pair of flange parts 32, 34 that are placed on both ends of it in a manner facing each other. The shaft part 36 has an oval section in the axial direction, as well as flat formed surfaces 36A, 36B formed through the forming step, and curved ground surfaces 36C, 36D formed through the grinding step. The flange parts 32, 34 correspond to the aforementioned flange parts 18, 20. Next, the ground product 30 is heat-treated to form a magnetic body. For the magnetic material, Ni—Zn ferrite is used if high insulation is required, Mn—Zn ferrite is used if current characteristics are required, or metal material is used if the current characteristics must be increased further, for example. Each magnetic material is heat-treated at a suitable temperature according to the magnetic material, and the dimensions of the compact are determined by considering the shrinkage caused by the heat treatment. On the drum core 40 thus obtained, as shown in FIG. 1E, terminal electrodes 44A, 44B are formed in a manner extending from the outer principal face to side face of the flange part 34, after which a conducive wire with sheath 42 is wound around the shaft part 36 and both ends of the conductive wire with sheath 42 are connected to the terminal electrodes 44A, 44B, respectively, and then an exterior part 46 is formed over the winding using a resin containing magnetic powder, etc., to form a coil component 50.

According to Example 1, as described above, a magnetic material is pressure-molded into a compact 16 of H-shaped section comprising a pair of flange parts 18, 20 that are facing each other and a web part 24 connecting the pair of flange parts 18, 20. Next, a hardened product of the compact 16 is turned around a rotational shaft X being the shaft passing through the centers of the principal faces 18A, 20A of the flange parts 18, 20, to grind the web part 24 and form a drum-type ground product 30 having a pair of flange parts 32, 34 that are facing each other on both ends of the shaft part 36. The flange parts 32, 34 each have an outer principal face orthogonal to the rotational shaft, and the outer periphery of the section of the shaft part 36 in the direction orthogonal to the rotational shaft is formed by a pair of straight parts that are facing each other and a pair of arc parts connecting the end parts of the pair of straight parts. The ground product 30 thus obtained is such that the pair of straight parts run parallel with the longitudinal direction of the principal faces of the flange parts 32, 34. And, the ground product 30 is heat-treated to obtain a drum core 40 being a magnetic body; accordingly, the following effects are achieved.

1) Because simple H-shaped dies 10 are used, any stress concentration on the dies 10 due to pressurization can be reduced and high pressure can be applied. As a result, the fill ratio of the magnetic material can be increased. To this end, or to achieve the aforementioned effect, the pressurization surfaces 16A, 16B must be flat over the entire surface or any concavity or projection should be kept to within 15% of the overall length of the compact 16. According to this method, a compact can be obtained without causing damage to the dies even when the flange thickness is equivalent to 0.2 mm, for example.

2) Because the magnetic material can have higher density, the strength of the flange parts 32, 34 can be ensured.

3) The uniform density at the time of pressure-molding suppresses deformation during sintering, which improves the mutual biting issue of drum cores 40.

4) Because the section of the shaft part 36 orthogonal to the axial direction is oval, any change in the tension of the conductive wire with sheath 42 can be suppressed as it is wound, which allows for stable winding.

5) Because the arc parts 38C, 38D of the shaft part 36 having an oval section are formed by means of grinding, dimensional adjustment of the flange parts 32, 34 becomes possible.

6) Due to the position relationship whereby the longitudinal direction of the principal faces of the flange parts 32, 34 is parallel with the straight parts of the outer periphery of the section of the shaft part 36, the extent of grinding can be adjusted according to the length of the flange parts 32, 34 in the longitudinal direction, to obtain the required axial cross-section area.

7) Furthermore, because the flange parts 18, 20 are longer than they are wide, which is a dimensional relationship used for typical chip-type components having sides whose length is different, the axial cross-section area can be effectively formed. To be specific, by adjusting the lengths of the straight parts of the outer periphery of the shaft section to an equivalent of the difference between the length and width of the flange parts 18, 20, any inefficiency of the wound area can be reduced.

Figure 13A:
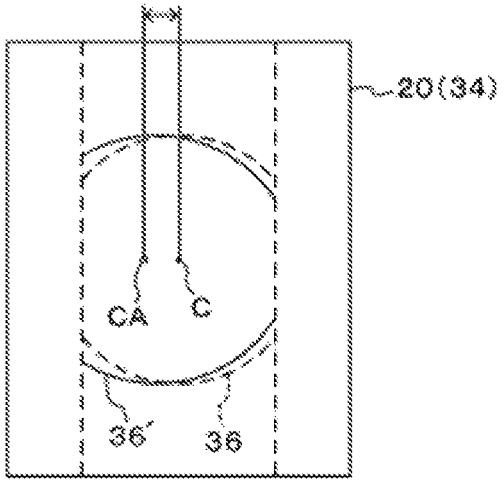
FIGS. 13A and 13B are drawings showing other examples of the present invention.
Figure 13B:
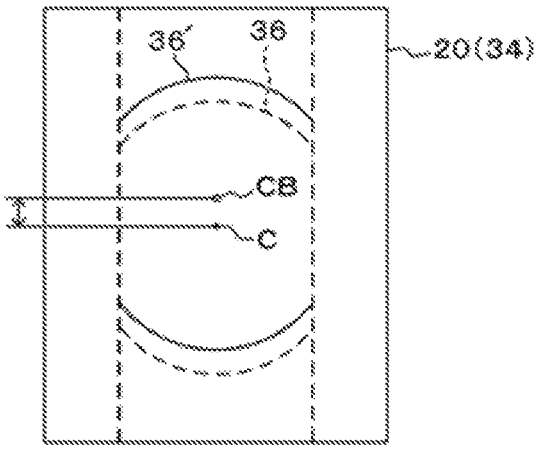

8) According to the method in this example, any impact of a position deviation of the rotational shaft X during grinding is minimal. FIGS. 13A and 13B are side views corresponding to the steps described in FIGS. 1C and 1D, each showing an example of the position of the rotational shaft. It should be noted that the term "flange part" in the explanation below corresponds to the "flange part" after the grinding. FIG. 13A is a drawing showing an example where the rotational shaft has deviated in the direction of the short side of the flange part 20. The shaft part 36 obtained by using the center C of the flange part 20 as the rotational shaft for grinding is indicated by the dotted line, while the shaft part 36' obtained by using, as the rotational center of grinding, the position CA deviating in the direction of the short side of the flange part 20 by 10% of the length of the short side from the center C, is indicated by the solid line. Even in this case, the axial cross-section area of the shaft part 36' does not decrease and the characteristics are not affected. The winding of the conductive wire with sheath 42 is not affected, either. Preferably the straight parts 38A, 38B have a length corresponding to 40 to 70% of the long side of the flange part 20 and both have the same length. However, even when the straight parts 38A, 38B have different lengths because the rotational shaft deviates in the direction of the short side as described above, the aforementioned effect can still be achieved, or specifically the wound area can be ensured in the same manner, so long as the straight parts 38A, 38B are present, which means that the conductive wire with sheath does not, as it is wound, project beyond the outer periphery surfaces of the flange parts 32, 34. Furthermore, the total length of the straight parts 38A, 38B only needs to be between 60 and 140% of the long side of the flange part. What this means is that, even when an exterior part 46 is to be formed later, there is no need to consider possible projection of the exterior part 46, etc., and an exterior part 46 of the required volume can be formed in a stable manner.

Additionally, FIG. 13B is a drawing showing an example where the rotational shaft deviates in the direction of the long side of the flange part 20. In this drawing, the shaft part 36 obtained by using the center C of the flange part 20 as the rotational shaft for grinding is indicated by the dotted line, while the shaft part 36' obtained by using, as the rotational center of grinding, the position CB deviating in the direction of the long side of the flange part 20 by 10% of the length of the long side from the center C, is indicated by the solid line. Even when the rotational shaft deviates in the direction of the long side of the flange part 20, as mentioned above, the axial cross-section area does not decrease and the characteristics are not affected. The winding of the conductive wire with sheath 42 is not affected, either.

Example 2

Next, Example 2 of the present invention is explained by referring to FIGS. 4A to 7D. It should be noted that those constitutional elements identical or corresponding to the applicable items in Example 1 are denoted using the same symbols (the same applies to the examples below). In this example, the same manufacturing method in Example 1 above is followed to pressure-mold a compact equivalent to H-beam steel using dies made of magnetic material, after which a web part of the compact is ground to form a shaft part of drum core; however, greater consideration is given to dimensional accuracy.

Figure 5A:
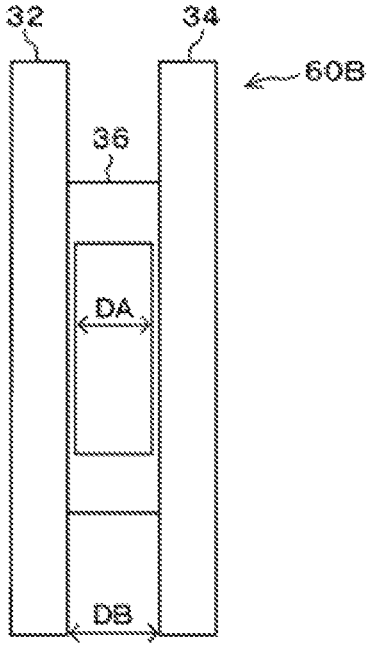
FIGS. 5A and 5B are drawings showing the structure of a ground product made with a grinding blade whose width is wider than the groove between the flange parts of the compact, where
Figure 5B:
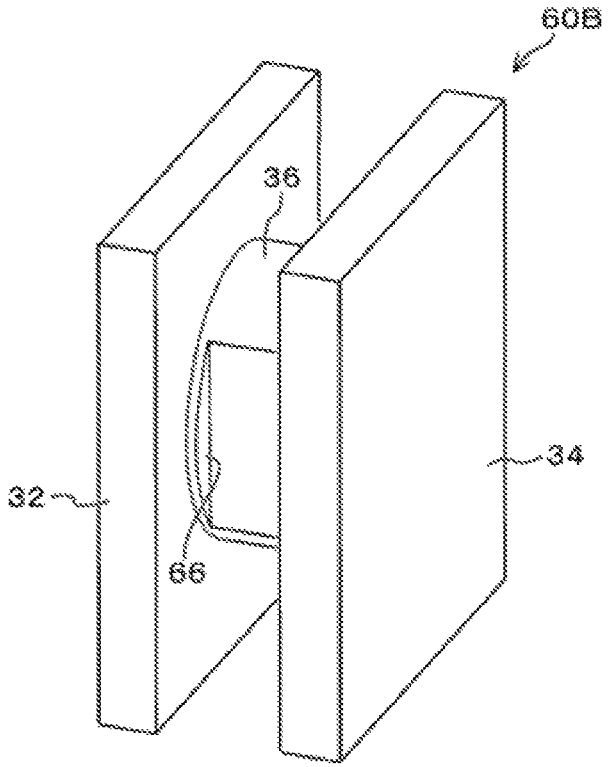

FIGS. 5A and 5B show a ground product 60B that has been ground using a blade whose width DB is wider than the spacing DA between the flange parts. FIG. 5A is a side view of the ground product 60B, while FIG. 5B is a perspective view of the exterior. In this case, circular step parts 66 remain around the shaft part 36, as shown in FIGS. 5A and 5B. Accordingly, here, the sizes of the step parts 66, as viewed in the thickness direction from the flange parts 32, 34, are kept to or below one-half the thickness of the conductive wire with sheath to be applied later. This prevents the conductive wire from riding over the step parts 66 as it is wound.

Figure 4A:
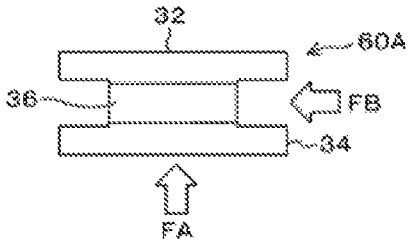
FIGS. 4A to 4D are drawings showing the structure of a ground product made with a grinding blade whose width is narrower than the groove between the flange parts of the compact, where
Figure 4B:
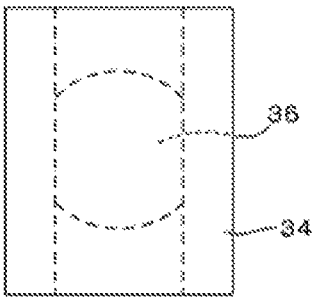
Figure 4C:
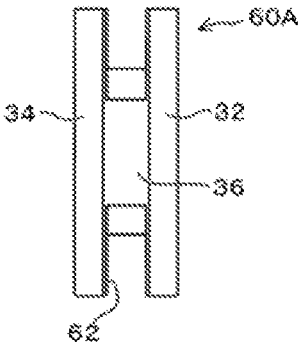
Figure 4D:
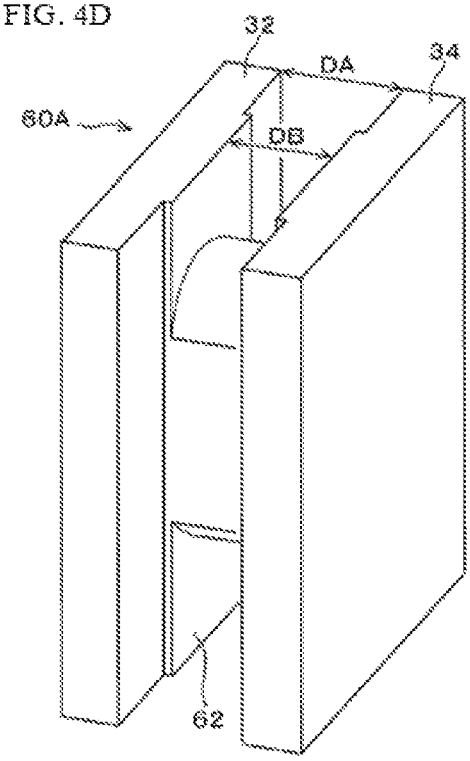

Furthermore, FIGS. 4A to 4D are examples of the very opposite of the above, showing a ground product 60A that has been ground using a blade whose width DB is narrower than the spacing DA between the outer margin parts of the pair of flange parts. FIG. 4A is a plan view from the pressurization direction of the compact, FIG. 4B is a side view of 4A from the direction of arrow FA, FIG. 4C is a side view of 4A from the direction of arrow FB, and FIG. 4D is a perspective view. As shown in FIGS. 4A to 4D, the grinding blade 28 does not contact the flange parts 18, 20 during grinding when the width DB of the grinding blade 28 is narrower than the spacing DA between the flange parts; however, step parts 62 remain above and below the shaft part 36. Accordingly, here, the sizes of the step parts 62, as viewed in the thickness direction from the flange parts 32, 34, are kept to or below one-half the thickness of the conductive wire with sheath to be applied later. This prevents the conductive wire from riding over the step parts 62 as it is wound.

Also, grinding using a grinding blade whose width DB is narrower than the spacing DA between the outer margin parts of the pair of flange parts has the following effects in addition to the effects in Example 1 above. To be specific, because the grinding blade 28 does not contact the flange parts 18, 20: (1) a drum core 40 being a magnetic body having thin flange parts 32, 34 can be obtained because the grinding load does not apply to the flange parts 18, 20; (2) the dimensional accuracy of the flange parts 18, 20 is roughly the same as the dimensional accuracy of the thickness of the flange parts 32, 34; and (3) the flange parts 32, 34 have a smooth inner face, which reduces chipping, break-off, etc., and suppresses damage to the conductive wire with sheath 42. Also when the conductive wire with sheath 42 is joined to the side faces of the flange parts 32, 34, connection stability with the terminal electrodes 44A, 44B can be obtained. This means that the thickness of the conductive wire with sheath 42 is not limited, because a thin conductive wire does not cause wire breakage and a thick conductive wire can still be joined.

In light of the above, and also from the viewpoint of dimensional accuracy, eliminating the step parts 62, 66 is difficult; accordingly, the following describes a way to prevent the conductive wire with sheath 42 from breaking or generating winding disorder despite some dimensional error. To be specific, in Example 2 and the subsequent examples, tapered surfaces are provided on the inside of the pair of flange parts of the pressure-molded compact, which is then ground in such a way that both ends of the grinding blade 28 contact the tapered surfaces, to chamfer the corners of the step parts and thereby prevent the aforementioned wire breakage and winding disorder.

Figure 6A:
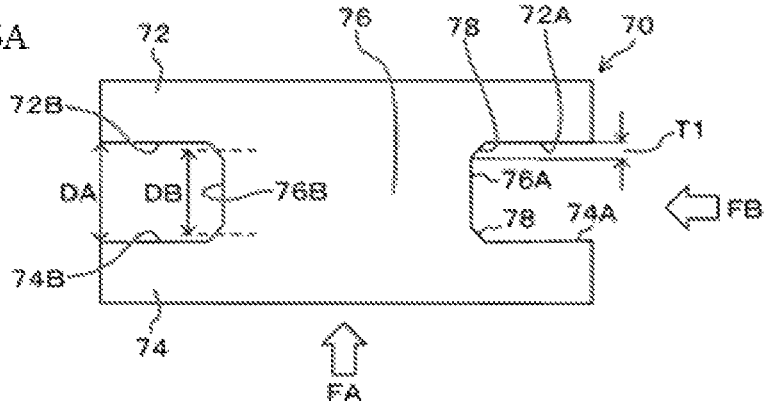
FIGS. 6A to 6C are drawings showing a compact used for forming the drum core in Example 2 of the present invention, where
Figure 6B:
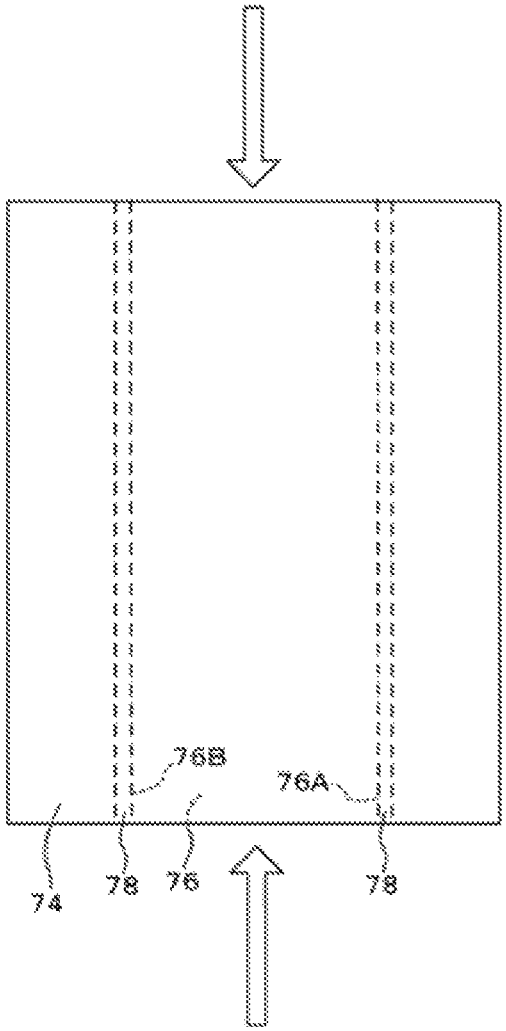
Figure 6C:
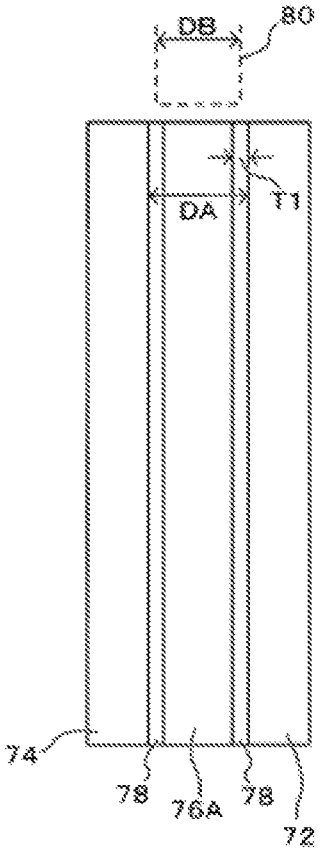
Figure 7D:
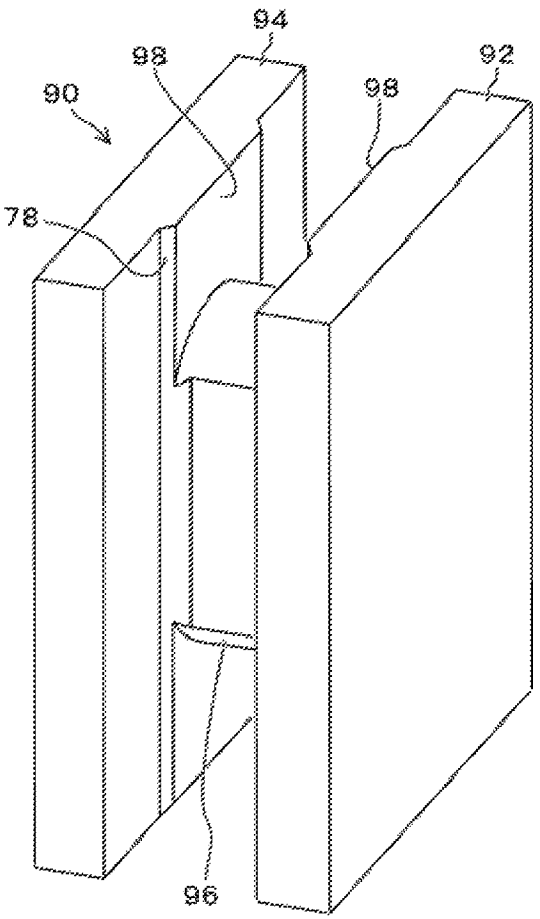
FIGS. 7A to 7D are drawings showing the ground product in Example 2, where
Figure 7C:
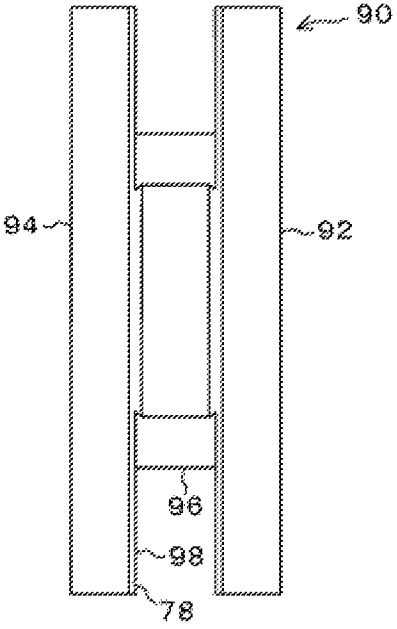
Figure 7A:
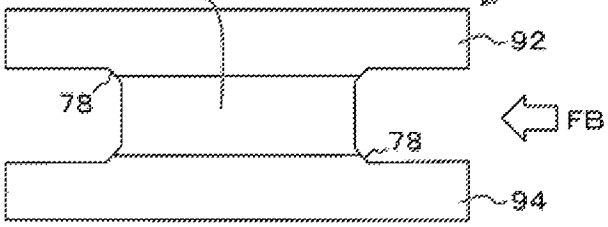
Figure 7B:
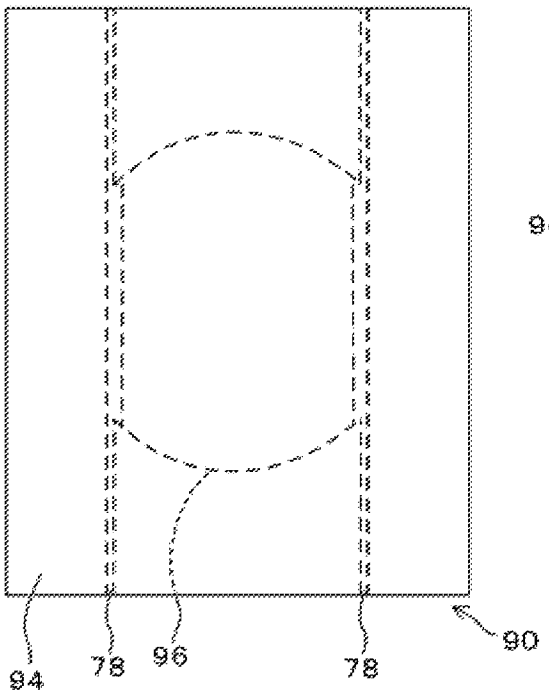

FIGS. 6A to 6C are drawings showing a compact from which to form the drum core in Example 2, where 6A is a plan view, 6B is a side view of 6A from the direction of arrow FA, and 6C is a side view of 6A from the direction of arrow FB. FIGS. 7A to 7D are drawings showing a ground product, where 7A is a plan view, 7B is a side view of 7A from the direction of arrow FA, 7C is a side view of 7A from the direction of arrow FB, and 7D is a perspective view of the exterior. In this example, tapered surfaces 78 are provided where the facing surfaces of a pair of flange parts 72, 74 of a pressure-molded compact 70 intersect a web part 76, as shown in FIGS. 6A to 6C.

To be specific, a tapered surface 78 is provided, along the pressurization direction shown by the arrow in FIG. 6B, at each of the four locations including the part where an inner face 72A of the flange part 72 intersects a side face 76A of the web part 76, the part where an inner face 72B of the flange part 72 intersects a side face 76B of the web part 76, the part where an inner face 74A of the flange part 74 intersects a side face 76A of the web part 76, and the part where an inner face 74B of the flange part 74 intersects a side face 76B of the web part 76. If the dimensions of the flange parts 72, 74 are the same as those in Example 1, then the width T1 of the flange parts 72, 74 in the thickness direction is adjusted to approx. 0.05 to 0.1 mm in the range where the tapered surfaces 78 are formed, as shown in FIGS. 6A and 6C. Then, as shown in FIG. 6C, grinding is performed by positioning a grinding blade 80 in such a way that both ends of it contact the tapered surfaces 78. In other words, grinding is performed by leaving parts of the tapered surfaces 78. It should be noted that, although the width of the tapered surface 78 is indicated using specific values here, it is good to keep the width to one-sixth the length of the shaft part or less for the purpose of ensuring winding space, and to one-fourth the thickness of the conductive wire with sheath 42 or more in consideration of wire breakage, etc., of the conductive wire with sheath 42. Also, if a rectangular wire is used for the conductive wire with sheath 42, the width is adjusted as deemed appropriate if necessary, such as to the curvature of the corner of the conductive wire with sheath 42 or more.

Grinding based on the positioning as described above provides a ground product 90 having a pair of flange parts 92, 94 on both sides of a shaft part 96. Step parts 98 remain above and below the shaft part 96, but since the tapered surfaces 78 remain between the step parts 98 and the inner faces of the flange parts 92, 94 and these parts function as chamfers, the conductive wire with sheath 42 does not ride over the step parts as it is wound and any winding disorder or wire breakage can be prevented. Also, because the tapered surfaces 78 can vary in width to some extent and both ends of the grinding blade 80 only need to contact them over this width range, similar effects can be achieved even with some positioning deviation or dimensional accuracy error. Other basic operations and effects are similar to those in Example 1 as described above.

Example 3

Next, Example 3 of the present invention is explained by referring to FIGS. 8A to 9D. In Example 3, tapered surfaces are provided on the pressure-molded compact, which is then ground in such a way that both ends of the grinding blade contact the tapered surfaces, to chamfer the corners of the step parts and thereby prevent the aforementioned wire breakage and winding disorder, in the same manner as described in Example 2 above.

Figure 8A:
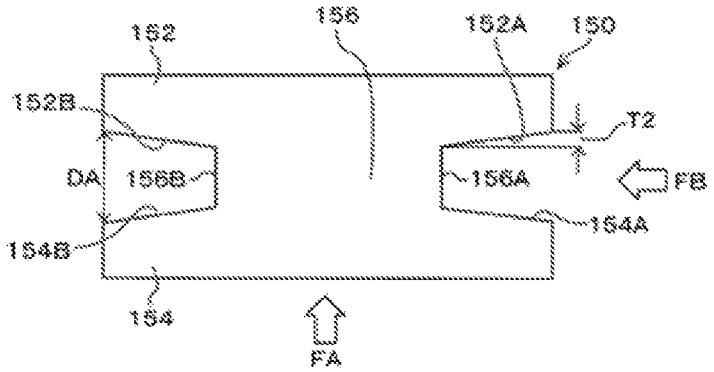
FIGS. 8A to 8C are drawings showing a compact used for forming the drum core in Example 3 of the present invention, where
Figure 8B:
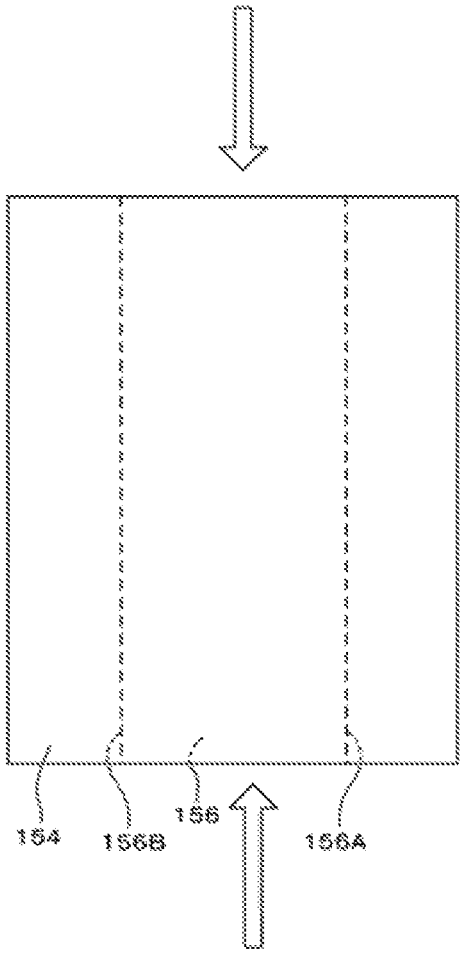
Figure 8C:
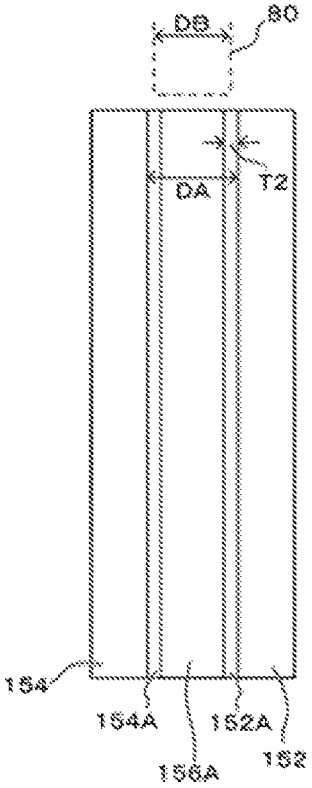
Figure 9D:
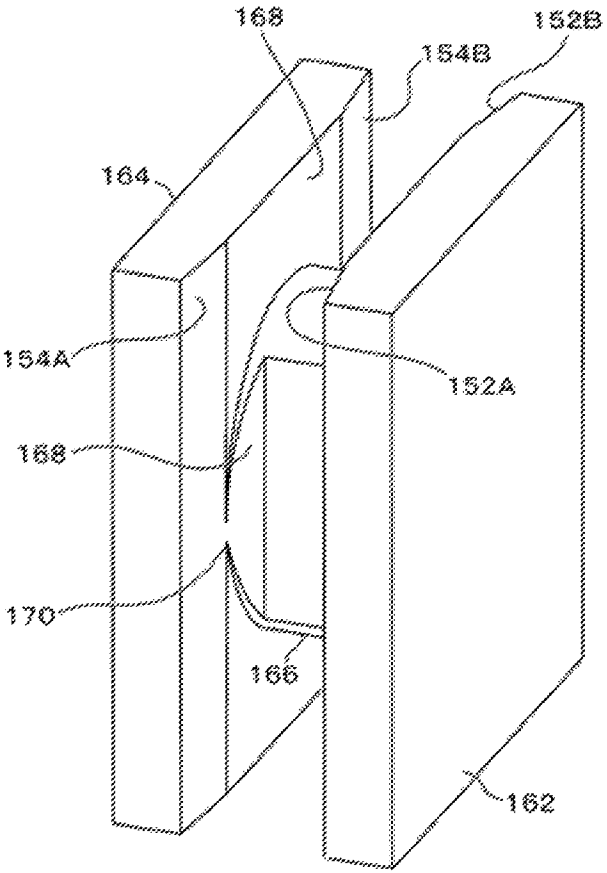
FIGS. 9A to 9D are drawings showing the ground product in Example 3, where
Figure 9C:
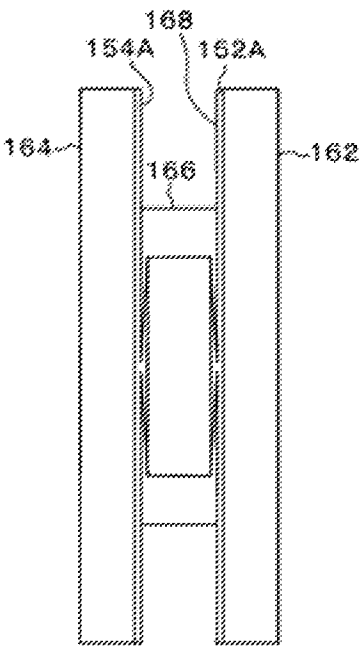
Figure 9A:
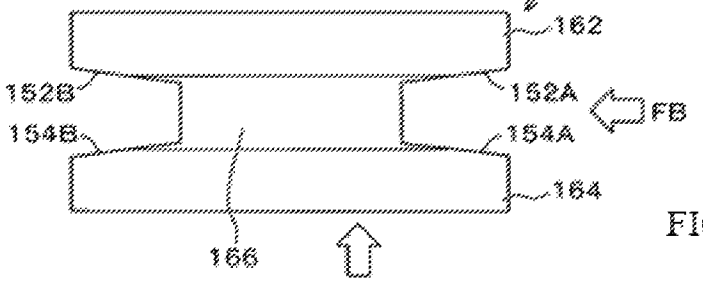
Figure 9B:
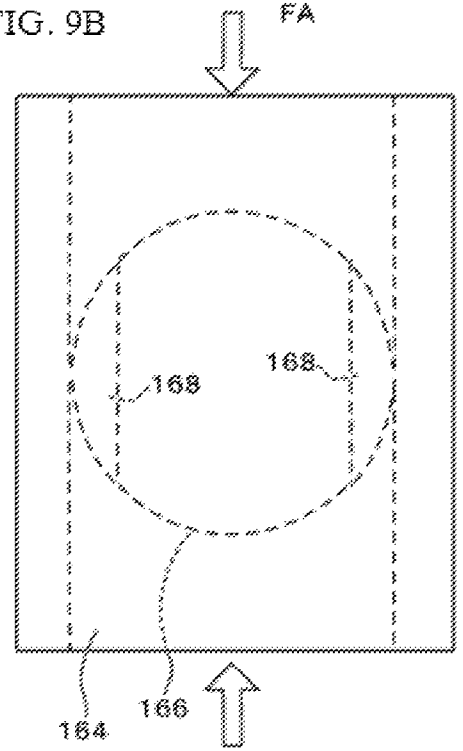

FIGS. 8A to 8C are drawings showing a compact from which to form the drum core in Example 3, where 8A is a plan view, 8B is a side view of 8A from the direction of arrow FA, and 8C is a side view of 8A from the direction of arrow FB. FIGS. 9A to 9D are drawings showing a ground product, where 9A is a plan view, 9B is a side view of 9A from the direction of arrow FA, 9C is a side view of 9A from the direction of arrow FB, and 9D is a perspective view of the exterior. In this example, tapered surfaces are provided on the facing surfaces of a pair of flange parts 152, 154 of a pressure-molded compact 150, in a manner extending from a web part 156 side toward the outer margin parts of the flange parts 152, 154 and causing the thickness of the flange parts 152, 154 to decrease.

To be specific, an inner face 152A of the flange part 152 constitutes a tapered surface which is inclined from a side face 156A of the web part 156 toward the outer margin part of the flange part 152 in such a way that the thickness of the flange part 152 decreases. Similarly, an inner face 152B of the flange part constitutes a tapered surface which is inclined from a side face 156B of the web part toward the outer margin part of the flange part 152 in such a way that the thickness of the flange part 152 decreases. The same goes with the other flange part 154 side, where an inner face 154A of the flange part 154 constitutes a tapered surface which is inclined from the side face 156A of the web part toward the outer margin part of the flange part 154 in such a way that the thickness of the flange part 154 decreases, while an inner face 154B of the flange part constitutes a tapered surface which is inclined from the side face 156B of the web part toward the outer margin part of the flange part 154 in such a way that the thickness of the flange part 154 decreases.

These tapered surfaces (specifically the inner faces 152A, 152B, 154A, 154B of the flange parts) are such that, when the dimensions of the flange parts 152, 154 are the same as those in Example 1 above, the width T2 of the flange parts 152, 154 in the thickness direction is adjusted to approx. 0.05 to 0.1 mm, as shown in FIGS. 8A and 8C. Then, as shown in FIG. 8C, grinding is performed by positioning the grinding blade 80 in such a way that both ends of it contact the tapered surfaces. It should be noted that, although the width of the tapered surface is indicated using specific values here, it is good to keep the width to one-third the thickness of the flange part or less for the purpose of ensuring strength of the flange part, and to one-fourth the thickness of the conductive wire with sheath 42 or more in consideration of wire breakage, etc., of the conductive wire with sheath 42. Also, if a rectangular wire is used for the conductive wire with sheath 42, the width is adjusted as deemed necessary, such as to the curvature of the corner of the conductive wire with sheath 42 or more.

Grinding based on the positioning as described above provides a ground product 160 having a pair of flange parts 162, 164 on both sides of a shaft part 166, while circular step parts 168 remain around the shaft part 166; however, since the step parts 168 are connected to the inner faces of the flange parts 162, 164 by tapered surfaces 170, the conductive wire with sheath 42 does not ride over the step parts 168 as the conductive wire with sheath 42 is wound around the shaft part 166 and therefore winding disorder or wire breakage can be prevented. Also, as the tapered surfaces 152A, 152B, 154A, 154B remain on the inner faces of the flange parts 162, 164, the conductive wire with sheath 42 does not get caught easily by the outer margin parts of the flange parts 162, 164. Furthermore, because the inner faces 152A, 152B, 154A, 154B of the flange parts 152, 154 of the compact 150 are used entirely as the tapered surfaces, similar effects can be achieved even when grinding deviates toward one flange part or dimensional accuracy error generates in the grinding width. Other basic operations and effects are similar to those in Example 1 as described above.

Example 4

Next, Example 4 of the present invention is explained by referring to FIGS. 10A to 11D. In Example 4, tapered surfaces are provided on the pressure-molded compact, which is then ground in such a way that both ends of the grinding blade contact the tapered surfaces, to chamfer the corners of the step parts and thereby prevent the aforementioned wire breakage and winding disorder, in the same manner as described in Example 2 above.

Figure 10A:
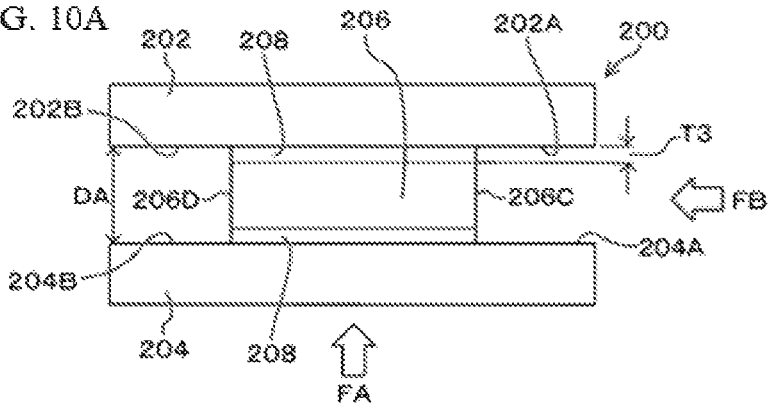
FIGS. 10A to 10C are drawings showing a compact used for forming the drum core in Example 4 of the present invention, where
Figure 10B:
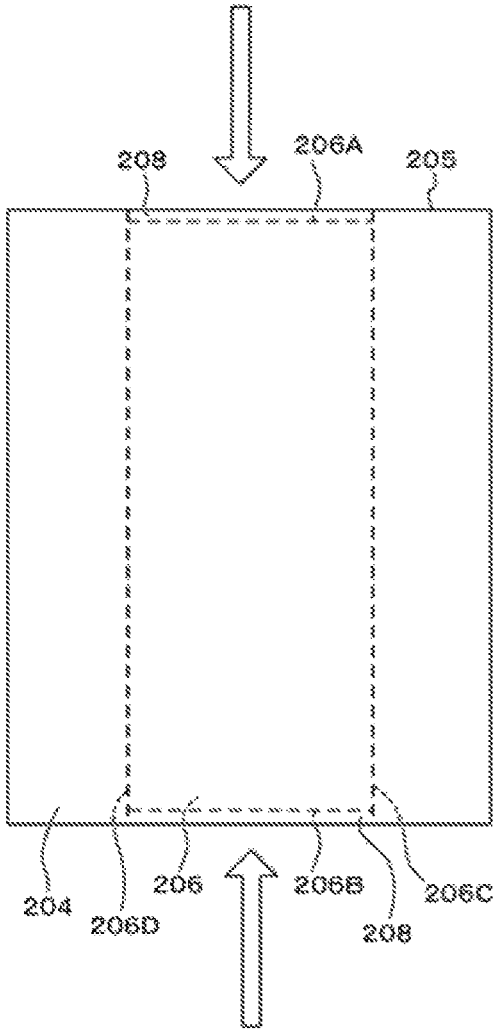
Figure 10C:
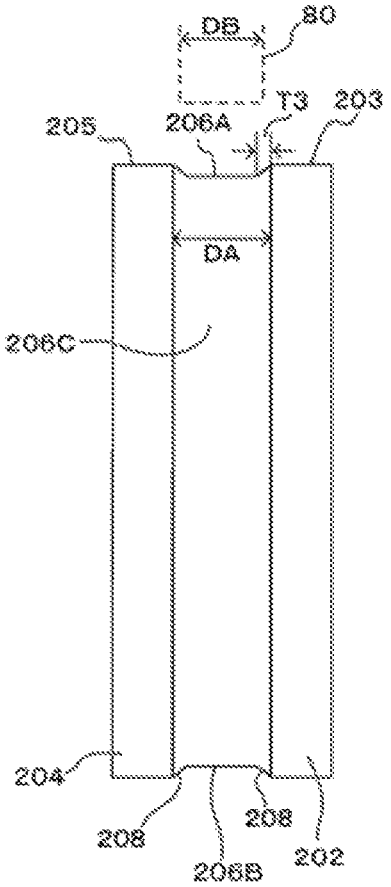
Figures 11A, 11B, 11C, 11D:
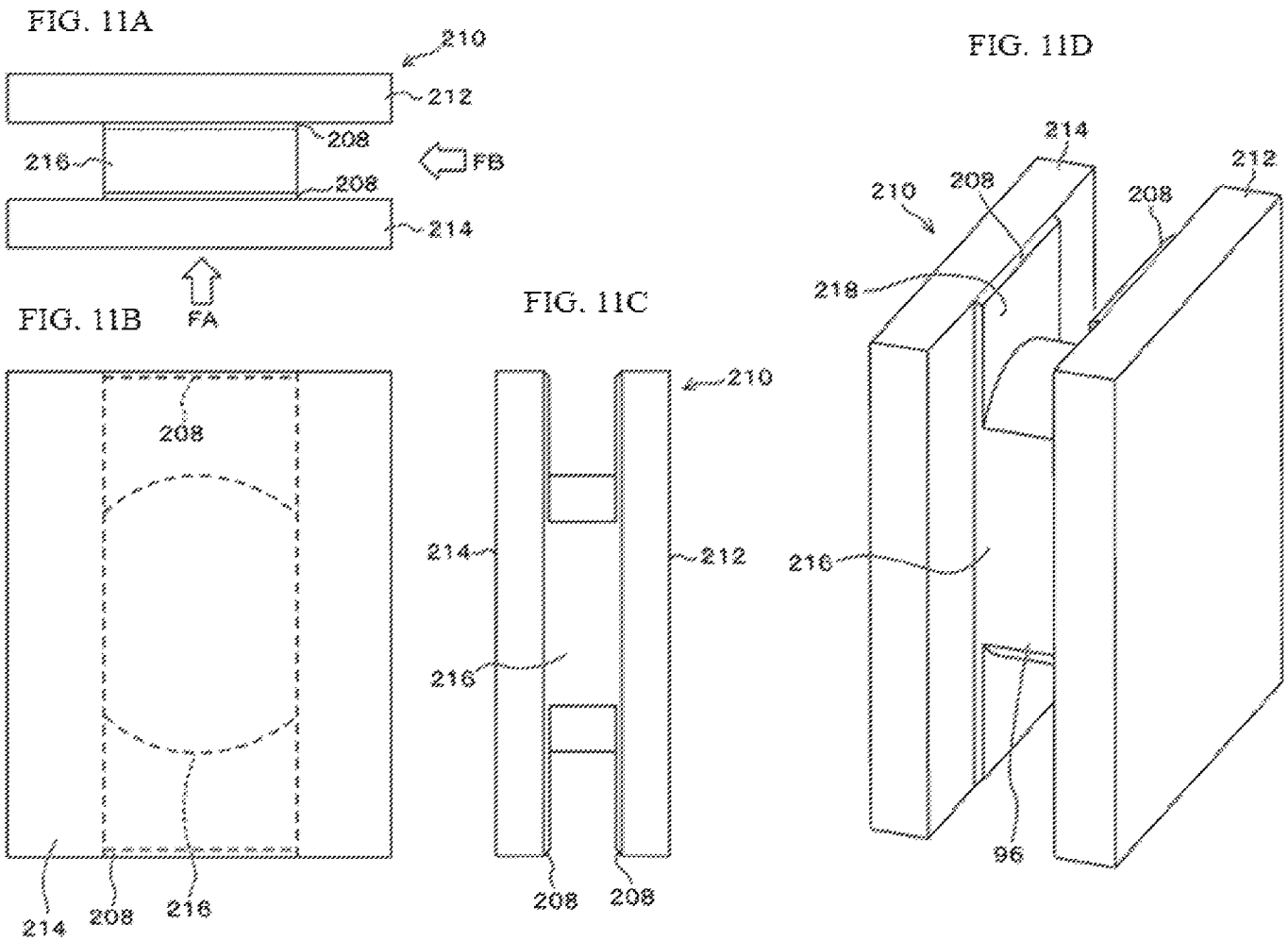
FIGS. 11A to 11D are drawings showing the ground product in Example 4, where

FIGS. 10A to 10C are drawings showing a compact from which to form the drum core in Example 4, where 10A is a plan view, 10B is a side view of 10A from the direction of arrow FA, and 10C is a side view of 10A from the direction of arrow FB. FIGS. 11A to 11D are drawings showing a ground product, where 11A is a plan view, 11B is a side view of 11A from the direction of arrow FA, 11C is a side view of 11A from the direction of arrow FB, and 11D is a perspective view of the exterior. In this example, tapered surfaces 208 where a web part 206 side is concaved are provided at four locations where outer margin parts 203, 205 of a pair of flange parts 202, 204 of a pressure-molded compact 200 intersect end faces 206A, 206B of a web part 206, as shown in FIG. 10A to 10C.

To be specific, a tapered surface 208 is provided on one end face 206A of the web part 206 at each of the locations where it intersects the outer margin parts 203, 205 of the flange parts 202, 204, in such a way that the center of the end face 206A is concaved. Similarly, a tapered surface 208 is provided on the other end face 206B of the web part 206 at each of the locations where it intersects the outer margin parts 203, 205 of the flange parts 202, 204, in such a way that the center of the end face 206B is concaved. A tapered surface 208 is provided at a total of four locations.

These tapered surfaces 208 are such that, if the dimensions of the flange parts 202, 204 are the same as those in Example 1, then the width T3 of the flange parts 202, 204 in the thickness direction is adjusted to approx. 0.05 to 0.1 mm, as shown in FIGS. 10A and 10C. Then, as shown in FIG. 10C, grinding is performed by positioning the grinding blade 80 in such a way that both ends of it contact the tapered surfaces 208. It should be noted that, although the width of the tapered surface 208 is indicated using specific values here, it is good to keep the width to one-third the thickness of the flange part or less for the purpose of ensuring strength of the flange part, and to one-fourth the thickness of the conductive wire with sheath 42 or more in consideration of wire breakage, etc., of the conductive wire with sheath 42. Also, if a rectangular wire is used for the conductive wire with sheath 42, the width is adjusted as deemed necessary, such as to the curvature of the corner of the conductive wire with sheath or more.

Grinding based on the positioning as described above provides a ground product 210 having a pair of flange parts 212, 214 on both sides of a shaft part 216. Step parts 218 remain above and below the shaft part 216, but since the tapered surfaces 208 remain between the step parts 218 and the flange parts 212, 214 and these parts function as chamfers, the conductive wire with sheath 42 does not ride over the step parts as it is wound and any winding disorder or wire breakage can be prevented. Also, because the tapered surfaces 208 can vary in width to some extent and both ends of the grinding blade 80 only need to contact them over this width range, similar effects can be achieved even with some positioning deviation or dimensional accuracy error. Other basic operations and effects are similar to those in Example 1 as described above.

Example 5

Figures 1, 12A:
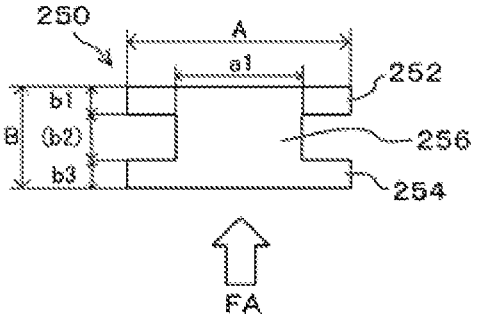
FIGS. 12A-1 to 12B-2 are plan views and side views showing the compact and ground product in Example 5 of the present invention.
Figures 1, 12B:
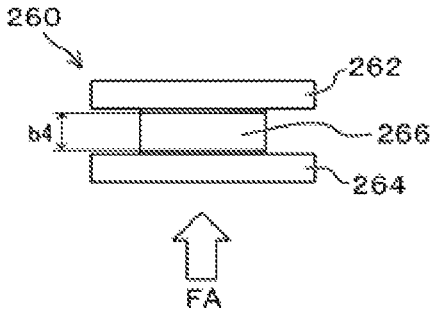
Figures 2, 12A:
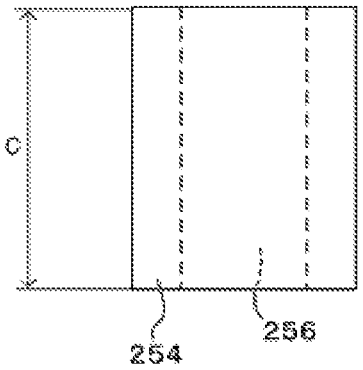
Figures 2, 12B:
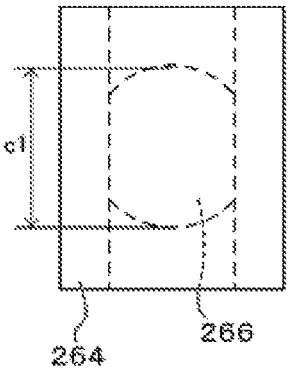

Next, Example 5 of the present invention is explained by referring to FIGS. 12A-1 to 12B-2. This example gives specific examples of materials that form the drum core proposed by the present invention, and their dimensions. FIG. 12A-1 is a plan view of the compact in this example from the pressurization direction, while FIG. 12A-2 is a side view of 12A-1 from the direction of arrow FA. FIGS. 12B-1 and 12B-2 are a plan view, and a side view, respectively, of a ground product obtained by grinding the compact. As shown in these drawings, a compact 250 in this example has virtually the same constitution as in Example 4 above, which is an H shape constituted by a web part 256 connecting a pair of flange parts 252, 254 that are facing each other. Also, the shape of the ground product 260 is such that a pair of flange parts 262, 264 are connected by a shaft part 266 having an oval section. An example of magnetic body dimensions corresponding to the respective parts mentioned above is shown in Table 1 below.

TABLE 1

(Unit: mm)

| | C × A × B | | | |
|---|---|---|---|---|
| | 2.5 × 2.0 × 0.9 | 2.5 × 1.6 × 0.85 | 2.0 × 1.25 × 0.8 | 1.6 × 0.8 × 0.6 |
| C | 2.5 | 2 | 2 | 1.6 |
| A | 2 | 1.6 | 1.25 | 0.8 |
| B | 0.9 | 0.85 | 0.8 | 0.7 |
| b1 | 0.25 | 0.23 | 0.2 | 0.2 |
| b2 | 0.25 | 0.23 | 0.2 | 0.2 |
| b3 | 0.4 | 0.39 | 0.4 | 0.3 |
| b4 | 0.3 | 0.31 | 0.35 | 0.25 |
| a1 | 0.9 | 0.75 | 0.575 | 0.38 |
| c1 | 1.4 | 1.1 | 1.275 | 1.15 |

It should be noted that the example of dimensions in Table 1 above shows dimensions of a magnetic body using alloy grains. When alloy grains are used, the compact 250 has roughly the same dimensions as the magnetic body. This is because heat treatment causes scarcely any shrinkage. If ferrite material is used, on the other hand, each dimension of the compact 250 is set in consideration of a shrinkage of approx. 16% of the compact 250.

Among the magnetic materials, Ni—Zn ferrite and Mn—Zn ferrite can be sintered in an oxidizing ambience of 1100° C., and in a nitrogen ambience of 1150° C., respectively (the sintering temperature ranges from 1000 to 1200° C.), into a magnetic body. Also, the molded and ground dimensions are increased from the respective numbers in Table 1 above by 16%. Since the material shrinks, the fill ratio at the time of molding becomes important, and deformation and micro-cracks may occur depending on how much the fill ratio varies. Under the present invention, on the other hand, the compact is obtained by pressure-molding using H-shaped dies and thus is uniform, so the aforementioned deformation and micro-cracks do not occur. Also, alloy magnetic grains of FeSiAl, FeSiCr, etc., can be sintered in an oxidizing ambience of 750° C. (the sintering temperature ranges from 600 to 900° C.). Oxide film is formed by this heat treatment and a magnetic body is obtained as a result. Since the material does not shrink, there is no deformation and good dimensional stability can be achieved. It should be noted that the materials and dimensions shown here are only examples and any of the various other known materials can be used, or the dimensions can be changed as deemed appropriate according to the purpose of the coil component.

The present invention is not limited to the above Examples, and various changes can be added to the extent that they do not deviate from the gist of the present invention. For example, the present invention also includes the following:

1) The shapes and dimensions shown in the above Examples are only examples and can be changed as deemed appropriate if necessary. Also, the section shape of the shaft part of each drum core is also an example, and although it is oval in Example 1 above, the arc part need not be a circular arc and, if necessary, it can be changed as deemed appropriate, such as to a combination of arcs of different curvatures. Also, the outer principal face of the flange part 34 of the drum core, which is rectangular in Example 1 above, can be changed as deemed appropriate, if necessary, by adding a groove or applying chamfering, or the like.

2) The dimensions and materials shown in Examples 1 and 5 above are also examples and can be changed as deemed appropriate according to the purpose of the coil component, etc., to the extent that similar effects can be achieved.

3) Examples 2 to 4 above can be combined to provide tapered surfaces at multiple locations.

4) The scope of formation of tapered surfaces in Examples 2 to 4 above are also examples and can be changed as deemed appropriate to the extent that similar effects can be achieved.

5) The terminal electrodes shown in the above Examples are also examples and their design can be changed as deemed appropriate to the extent that similar effects can be achieved.

6) A drum core formed according to the manufacturing method proposed by the present invention can be used favorably for wound components such as wound inductances; however, the application is not limited to the foregoing and it can be applied widely for transformers, common mode choke coils, etc.

According to the present invention, a drum core is manufactured through a step to pressure-mold magnetic material into a compact having an H-shaped section, constituted by a pair of flange parts that are facing each other and a web part connecting the pair of flange parts; a step to turn the compact around the center parts of the principal faces of the flange parts, and grind the web part to form a drum-type ground product having a pair of flange parts on both ends of the shaft part; and a step to heat-treat the ground product to obtain a drum-type magnetic body. The obtained drum core offers high design flexibility in terms of axial section shape, supports higher fill ratio of magnetic body, prevents wire breakage and winding disorder of the wound wire, and enables improvement of winding efficiency, and it can therefore be applied as a drum core for coil components.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A drum-type magnetic body comprising:

a pair of flange parts that are facing each other in a first direction; and a shaft part connecting the pair of flange parts in the first direction, wherein an outer periphery of a cross section of the shaft part in a direction orthogonal to the first direction has an oval shape constituted by a pair of parallel straight parts facing each other in a second direction and a pair of arc parts facing each other in a third direction and connecting end parts of the pair of parallel straight parts, wherein the pair of arc parts define a major axis of the oval shape and consist of parts of a regular circle whose diameter is the major axis, and the pair of parallel straight parts are entirely inside the regular circle, and the flange parts each have an outer principal face running orthogonal to the first direction, and the pair of parallel straight parts of the shaft part are running in the third direction parallel with a longitudinal direction of the outer principal face of the flange part.

2. A drum-type magnetic body according to claim 1, wherein a ratio of width and length of the flange parts is substantially the same as a ratio of width of the parallel straight parts of the shaft part and longest length of the arc parts of the shaft part.

3. A drum-type magnetic body according to claim 1, wherein:

the flange parts each have two first inner principal faces and two second inner principal faces each running around the shaft part in parallel with the outer principal face, wherein the two first inner principal faces sandwich the shaft part in the second direction and are separated by the two second inner principal faces, and the two second inner principal faces sandwich the shaft part in the third direction, and a distance between the second inner principal faces of the flange parts facing each other in the first direction is shorter than a distance between the first inner principal faces of the flange part facing each other in the first direction.

4. A drum-type magnetic body according to claim 1, wherein a distance between the facing surfaces of the pair of flange parts at the arc parts of the shaft part is longer than a distance between the facing surfaces of the pair of flange part at the parallel straight parts of the shaft part.

5. A drum-type magnetic body according to claim 1, wherein:

the flange parts each have an inner principal face running around the shaft part in parallel with the outer principal face, and tapered surfaces are provided where the inner principal face of each of the pair of flange parts of the compact intersects the shaft part.

6. A drum-type magnetic body according to claim 1, wherein tapered surfaces are provided on the facing surfaces of the pair of flange parts in an manner that a thickness of each flange part decreases from a portion connecting the shaft part toward an outer margin part of the flange part.

7. A coil component comprising the drum-type magnetic body of claim 1 and a conductive wire with sheath wound around the shaft part.

8. A coil component according to claim 7, further comprising:

terminal electrodes formed in a manner extending from the outer principal face to side faces of one of the flange parts, wherein both ends of the conductive wire with sheath are connected to the terminal electrodes, respectively; and an exterior part formed over the wound wire using a resin containing magnetic powder.

9. A drum-type magnetic body according to claim 1, wherein each of the flange parts has a roughly rectangular shape as viewed in the first direction.

* * * * *